US007060952B1

(12) United States Patent
Chen

(10) Patent No.: US 7,060,952 B1
(45) Date of Patent: Jun. 13, 2006

(54) INDUCTION HEATING COIL DEVICE

(76) Inventor: Shia Chung Chen, 11F, No. 14, Lane 236, Sec. 1, Juanjin Road, Taoyuan City, Taoyuan Hsien 33044 (TW)

( * ) Notice: Subject to any disclaimer, the term of this patent is extended or adjusted under 35 U.S.C. 154(b) by 0 days.

(21) Appl. No.: 11/063,370

(22) Filed: Feb. 22, 2005

Related U.S. Application Data

(62) Division of application No. 10/680,057, filed on Oct. 6, 2003, now Pat. No. 6,919,545.

(51) Int. Cl.
*H05B 6/10* (2006.01)

(52) U.S. Cl. ..... 219/672; 219/633; 428/409

(58) Field of Classification Search ..... 219/672, 219/656, 671, 674, 675, 632, 633–635, 619, 219/607, 609, 643, 646, 650; 148/567, 571, 148/646; 336/57, 183, 220; 399/328, 330, 399/331; 428/409
See application file for complete search history.

(56) References Cited

U.S. PATENT DOCUMENTS

| | | | | |
|---|---|---|---|---|
| 2,182,820 | A | 12/1939 | Pisarev | |
| 2,604,419 | A | 7/1952 | Herbenar | |
| 4,439,492 | A * | 3/1984 | Wada et al. | 428/409 |
| 5,139,407 | A * | 8/1992 | Kim et al. | 425/174.8 E |
| 5,641,422 | A * | 6/1997 | Matsen et al. | 219/633 |
| 6,555,801 | B1 | 4/2003 | LeMieux et al. | 219/656 |
| 2004/0004071 | A1 | 1/2004 | Ogasawara et al. | |

* cited by examiner

*Primary Examiner*—Quang Van
(74) *Attorney, Agent, or Firm*—Charles E. Baxley

(57) ABSTRACT

An induction heating coil device includes a workpiece having one or more planar surfaces, and an induction coil having a number of coil turns arranged in inwardly converging shape and arranged to have planes of the coil turns offset from each other for generating high frequency wave. The planes of the coil turns are disposed parallel to the planar surfaces of the workpiece, for allowing the workpiece to be evenly or uniformly heated by the high frequency wave generated by the coil turns of the induction coil. The induction coil may include one or more insulating rings attached onto the coil turns, for preventing the coil turns from being electrically contacted with the planar surface of the workpiece.

4 Claims, 6 Drawing Sheets

Temperature distribution

Magnetism density

Temperature distribution

Magnetism density

Temperature distribution

Infrared thermal image

INDUCTION HEATING COIL DEVICE

The present invention is a divisional application of U.S. patent application Ser. No. 10/680,057, filed 6 Oct. 2003, now U.S. Pat. No. 6,919,545.

BACKGROUND OF THE INVENTION

1. Field of the Invention

The present invention relates to an induction heating coil device, and more particularly to a high frequency induction heating coil device for generating high frequency wave or high frequency magnetic field or magnetic force and for evenly or uniformly heating objects or workpieces.

2. Description of the Prior Art

Various kinds of typical induction heating coil devices have been developed and comprise one or more high frequency induction coils provided for generating high frequency waves or high frequency magnetic field or magnetic force and for heating various objects, such as industrial die or mold devices, ovens, rice cookers, or other workpieces.

For example, U.S. Pat. No. 2,182,820 to Pisarev, discloses one of the typical induction heating coil devices including an induction coil having its end portions arranged in inwardly converging or offset relation in contrast to the conventional cylindrical type of coils.

However, the induction coil that is disposed within a susceptor or object or workpiece is disposed or arranged to have the planes of the coil turns substantially perpendicular to the susceptor, such that the flux or the magnetic field generated externally of the coil will be substantially parallel to the susceptor, and such that the susceptor or object or workpiece may not be suitably or evenly or uniformly heated.

U.S. Pat. No. 2,604,419 to Herbenar discloses another typical method for heat-treating surface hardened article and comprises a conventional cylindrical type induction coil disposed within an inner hardened layer or surface of a cylinder liner, or disposed or positioned exteriorly of an outer layer or surface of the cylinder liner.

However, the cylindrical induction coil is also disposed or arranged to have the planes of the coil turns substantially perpendicular to the cylinder liner or object or workpiece, such that the flux or the magnetic field generated externally of the induction coil will also be substantially parallel to the cylinder liner, and such that the cylinder liner may not be suitably or evenly or uniformly heated by the induction coil.

U.S. Pat. No. 6,555,801 to LeMieux et al. discloses a further typical induction heating coil device also including a conventional cylindrical or solenoid type induction coil disposed exteriorly of or around a workpiece, and at least one pancake-type induction heating coil positioned within a portion of the cylindrical or solenoid type induction coil.

However, similarly, the cylindrical induction coil and the pancake-type induction heating coil are also disposed or arranged to have the planes of the coil turns substantially perpendicular to the workpiece, such that the flux or the magnetic field generated externally of the induction coil will also be substantially parallel to the workpiece, and such that the workpiece may not be suitably or evenly or uniformly heated by the induction coil.

U.S. Patent Publication No. US-2004/0004071 A to Ogasawara et al. discloses a still further typical induction heating coil device also including a conventional cylindrical or solenoid type induction coil disposed within a workpiece or a heating roller.

However, similarly, the cylindrical induction coil is also disposed or arranged to have the planes of the coil turns substantially perpendicular to the heating roller, such that the flux or the magnetic field generated externally of the induction coil will also be substantially parallel to the heating roller, and such that the heating roller may not be suitably or evenly or uniformly heated by the induction coil.

The present invention has arisen to mitigate and/or obviate the afore-described disadvantages of the conventional induction heating coil devices.

SUMMARY OF THE INVENTION

The primary objective of the present invention is to provide an induction heating coil device for generating high frequency wave or high frequency magnetic field or magnetic force and for evenly or uniformly heating various objects or workpieces.

In accordance with one aspect of the invention, there is provided a induction heating coil device comprising a workpiece including at least one planar surface, and an induction coil including a plurality of coil turns arranged in inwardly converging and arranged to have planes of the coil turns offset from each other for generating high frequency wave. The planes of the coil turns being disposed parallel to the planar surface of the workpiece, for allowing the workpiece to be suitably or evenly or uniformly heated by the high frequency wave generated by the coil turns of the induction coil.

The workpiece includes a chamber formed therein, and defined by the planar surface. For example the workpiece may further include an insert disposed within the chamber thereof, the insert includes a mold cavity formed therein, and defined by a second planar surface, the second planar surface is disposed parallel to the planes of the coil turns.

The induction coil includes at least one insulating ring attached onto the coil turns, for contacting with the planar surface of the workpiece, and for preventing the coil turns from being electrically contacted with the planar surface of the workpiece. Alternatively, the induction coil may include an insulating layer applied onto the coil turns.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
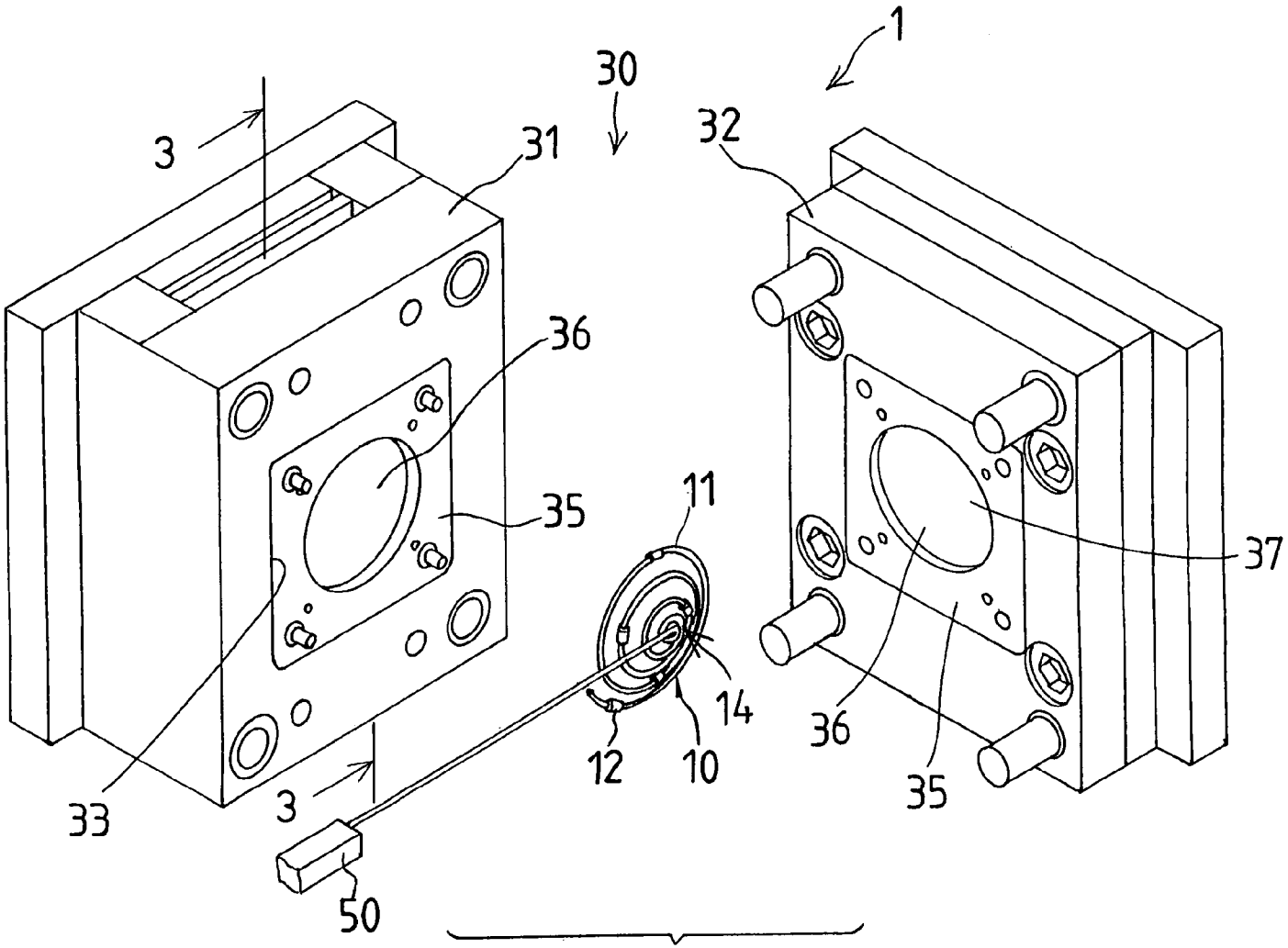
FIG. 1 is a partial exploded view of an induction heating coil device in accordance with the present invention.
Figure 2:
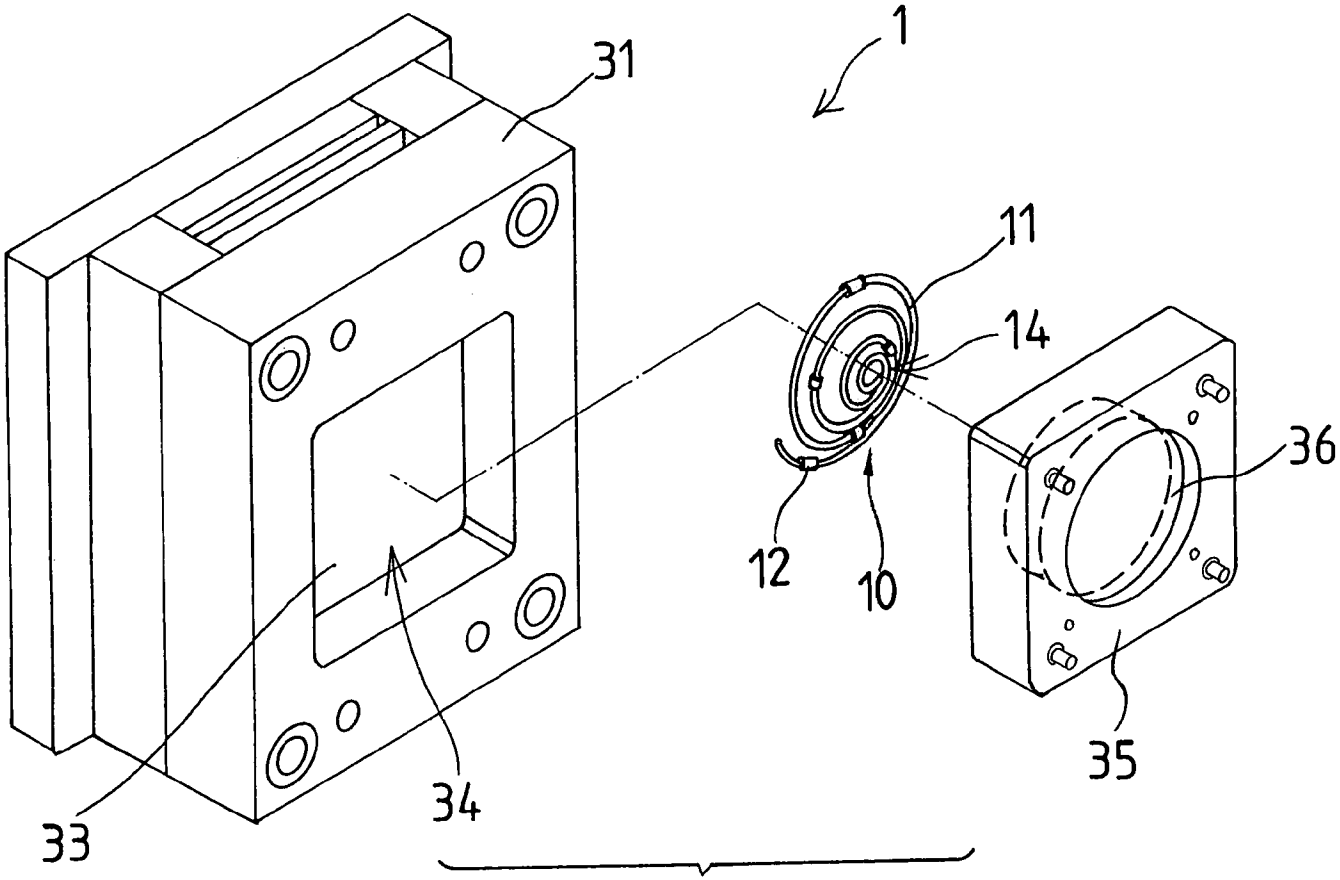
FIG. 2 is another partial exploded view of the induction heating coil device.
Figure 3:
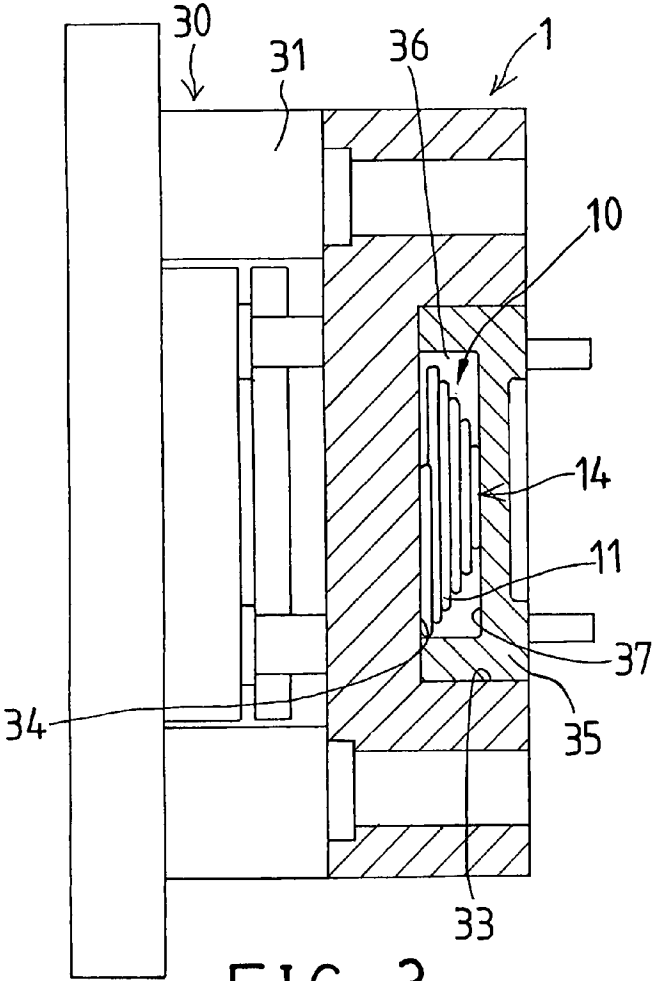
FIG. 3 is a partial cross sectional view of the induction heating coil device, taken along lines 3—3 of FIG. 1.

Referring to the drawings, and initially to FIGS. 1–3, an induction heating coil device 1 in accordance with the present invention comprises an induction coil 10 including a number of coil turns 11 arranged in inwardly converging shape having a narrowed or converged end portion 14 formed therein, or arranged to have the planes of the coil turns 11 offset from each other, or arranged in such as a pancake-shaped spatial structure, for generating high frequency wave or high frequency magnetic field or magnetic force and for evenly or uniformly heating various objects or workpieces 30.

For example, the workpiece 30 as shown in FIGS. 1–3 is an industrial die or mold device 30 including one or more mold pieces 31, 32 each having a chamber 33 formed therein, and defined by a planar surface 34, such as a planar bottom surface 34, and each having an insert 35 disposed or engaged within the chamber 33 of the mold pieces 31, 32. The insert 35 includes a mold cavity 36 formed therein, and defined by a planar surface 37, such as a planar bottom surface 37, for receiving the coil turns 11 of the induction coil 10.

As shown in FIG. 3, the planes of the coil turns 11 of the induction coil 10 are disposed or arranged substantially parallel to the planar surfaces 34, 37 of the mold pieces 31, 32 and/or of the insert 35 of the workpiece 30. Similarly, as shown in FIG. 4, the planes of the coil turns 11 of the induction coil 10 are also disposed or arranged substantially parallel to the planar surfaces 34 of the workpiece 30.

Figure 4:
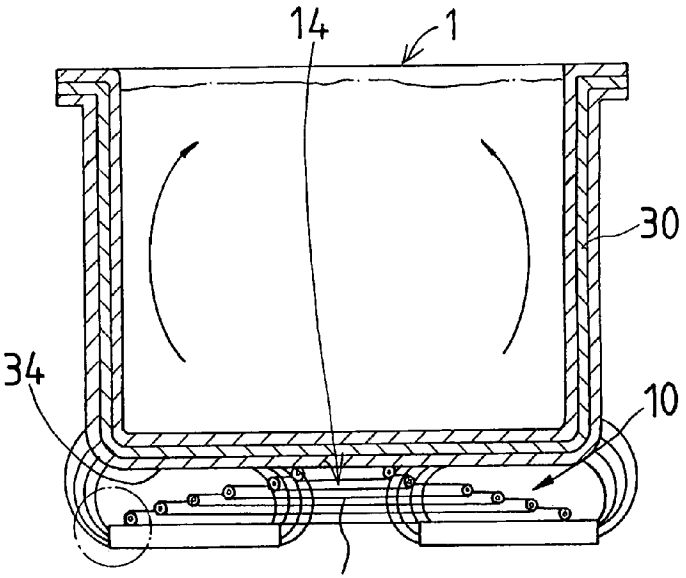
FIG. 4 is a partial cross sectional view illustrating the other arrangement of the induction heating coil device.

In operation, as best shown in FIG. 4, the high frequency wave or high frequency magnetic field or magnetic force generated by the coil turns 11 of the induction coil 10 will be substantially perpendicular to the planar surfaces 34, 37 of the workpiece 30, for allowing the workpieces 30 to be suitably or evenly or uniformly heated by the high frequency wave or high frequency magnetic field or magnetic force generated by the coil turns 11 of the induction coil 10.

Figure 6:
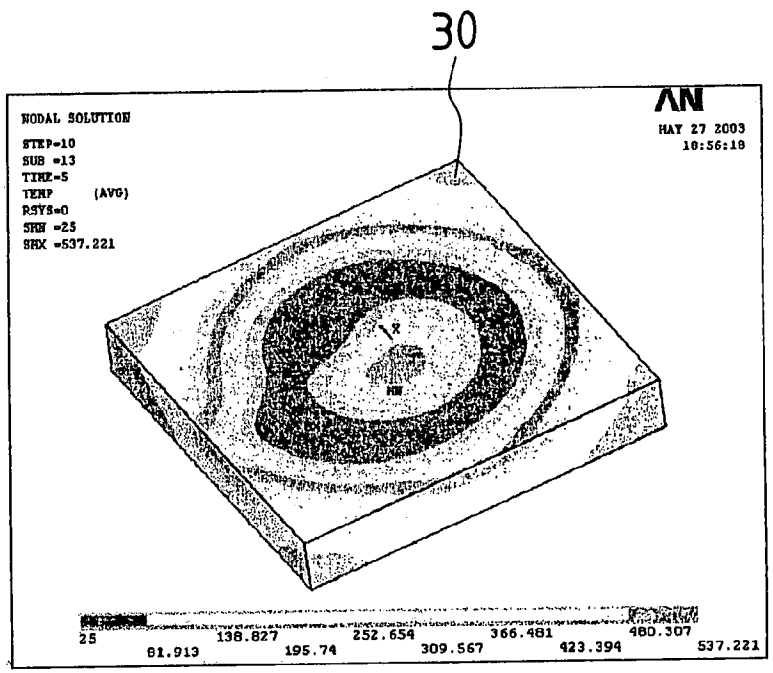
FIG. 6 is a diagram illustrating the temperature distribution and the magnetism density that may be generated by the induction heating coil device.
Figure 6:
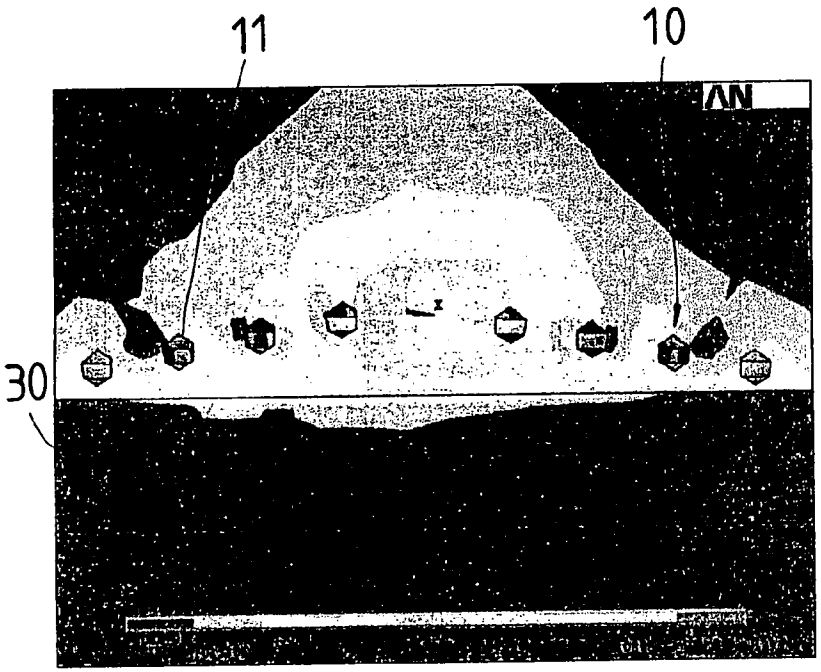
Figure 7:
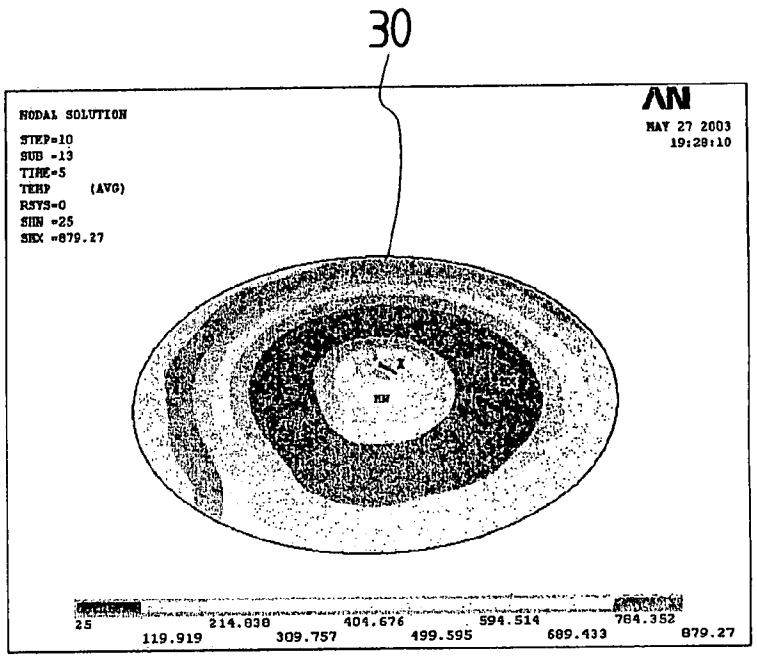
FIG. 7 is a diagram similar to FIG. 6, illustrating the further temperature distribution and the magnetism density that may be generated by the induction heating coil device.
Figure 7:
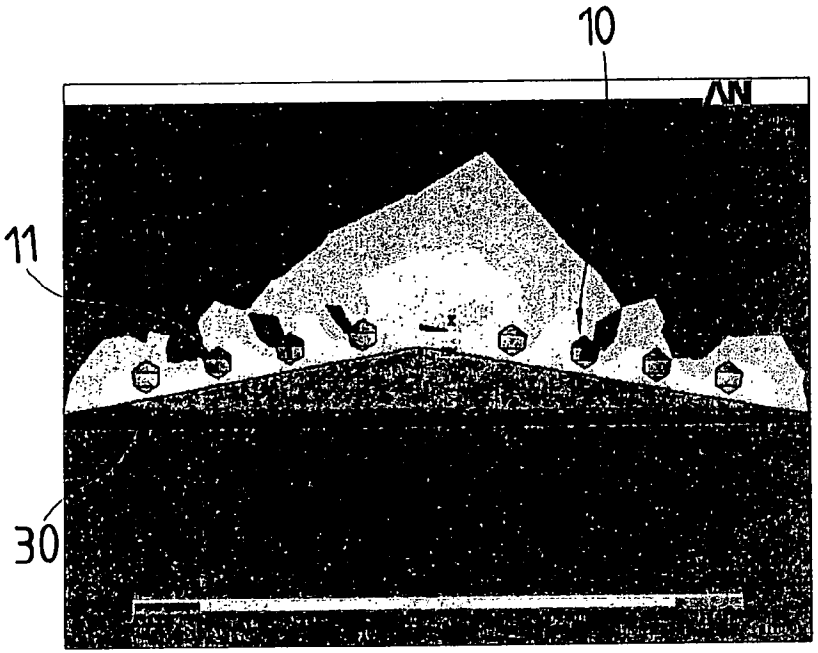
Figure 8:
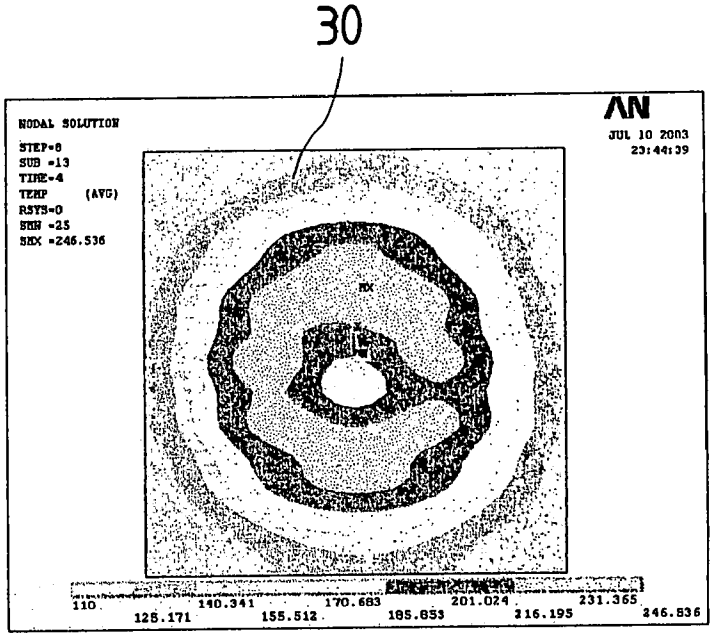
FIG. 8 is a diagram similar to FIGS. 6 and 7, illustrating the other temperature distribution and the magnetism density that may be generated by the induction heating coil device.
Figure 8:
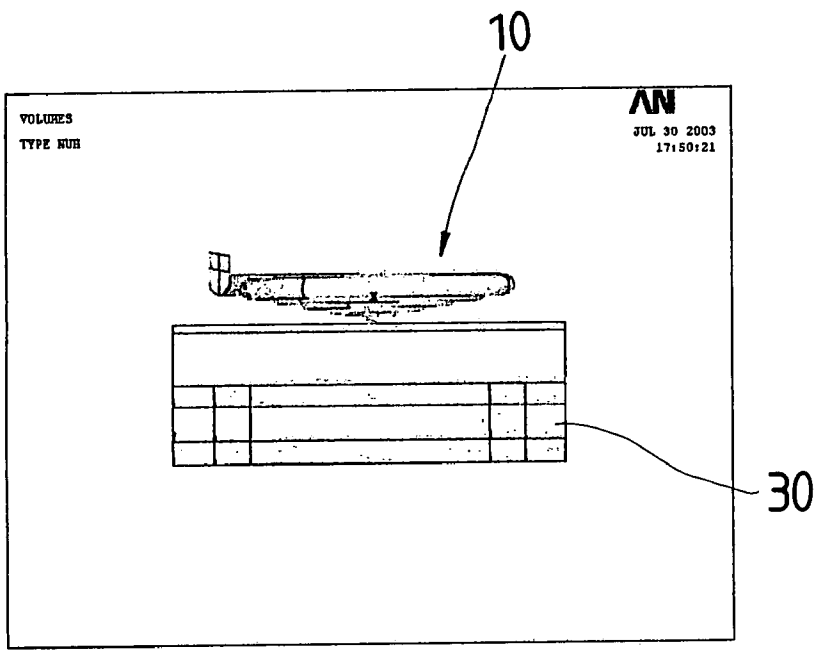

For example, as shown in FIGS. 6–8, illustrated are three examples of the temperature distribution and the magnetism density generated or conducted by the induction heating coil device 1. In these drawing figures, the workpieces 30 may be suitably or evenly or uniformly heated by the high frequency wave or high frequency magnetic field or magnetic force generated by the coil turns 11 of the induction coil 10.

As shown in FIG. 1, the induction coil 10 may be coupled to a moving device 50, such as a robot device 50, for allowing the induction coil 10 to be moved relative to the workpiece 30 by the moving device 50, and for allowing the workpiece 30 to be further evenly or uniformly heated by the high frequency wave or high frequency magnetic field or magnetic force generated by the coil turns 11 of the induction coil 10.

Referring again to FIGS. 1 and 2, for preventing the coil turns 11 of the induction coil 10 from being directly contacted with the planar surfaces 34, 37 of the workpiece 30, one or more insulating rings 12, such as ceramic insulating rings 12 may further be provided and engaged or attached onto the coil turns 11 of the induction coil 10, for contacting or engaging with the planar surfaces 34, 37 of the workpiece 30, in order to space the coil turns 11 of the induction coil 10 away from the planar surfaces 34, 37 of the workpiece 30, and so as to prevent the coil turns 11 of the induction coil 10 from being electrically contacted with the planar surfaces 34, 37 of the workpiece 30.

Figure 5:
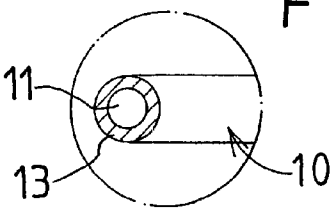
FIG. 5 is an enlarged partial cross sectional view of the induction heating coil device.

Alternatively, as shown in FIGS. 4 and 5, an insulating outer layer or coating 13 may further be provided and engaged or applied onto the outer peripheral portions of the coil turns 11 of the induction coil 10, for contacting or engaging with the planar surfaces 34, 37 of the workpiece 30, in order to space the coil turns 11 of the induction coil 10 away from the planar surfaces 34, 37 of the workpiece 30, and so as to prevent the coil turns 11 of the induction coil 10 from being electrically contacted with the planar surfaces 34, 37 of the workpiece 30.

The conventional or the typical induction heating coil devices fail to provide a number of coil turns 11 of an induction coil 10 arranged in inwardly converging shape having a narrowed or converged end portion 14 formed therein, or arranged to have the planes of the coil turns 11 offset from each other, or arranged in a pancake-shape, and having the planes of the coil turns 11 disposed or arranged substantially parallel to the planar surfaces 34, 37 of the workpieces 30, to allow the high frequency wave or high frequency magnetic field or magnetic force generated by the coil turns 11 to be substantially perpendicular to the planar surfaces 34, 37 of the workpieces 30.

Accordingly, the induction heating coil device in accordance with the present invention may be provided for generating high frequency wave or high frequency magnetic field or magnetic force and for suitably or evenly or uniformly heating various objects or workpieces.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An induction heating coil device comprising:

a workpiece including at least one planar surface, an induction coil including a plurality of coil turns arranged in inwardly converging and arranged to have planes of said coil turns offset from each other for generating high frequency wave, and including at least one insulating ring attached onto said coil turns for contacting with said at least one planar surface of said workipiece and for preventing said coil turns from being electrically contacted with said at least one planar surface of said workpiece, and said planes of said coil turns being disposed parallel to said at least one planar surface of said workpiece, for allowing said workpiece to be uniformly heated by the high frequency wave generated by said coil turns of said induction coil.

2. The induction heating coil device as claimed in claim 1, wherein said workpiece includes a chamber formed therein, and defined by said at least one planar surface.

3. The induction heating coil device as claimed in claim 1, wherein said induction coil includes an insulating layer applied onto said coil turns.

4. An induction heating coil device comprising:

a workpiece including at least one planar surface, and including a chamber formed therein and defined by said at least one planar surface, said workpiece includes an insert disposed within said chamber thereof, said insert including a mold cavity formed therein, and defined by a second planar surface, an induction coil including a plurality of coil turns arranged in inwardly converging and arranged to have planes of said coil turns offset from each other for generating high frequency wave, and said planes of said coil turns being disposed parallel to said at least one planar surface of said workpiece, for allowing said workpiece to be uniformly heated by the high frequency wave generated by said coil turns of said induction coil, and said second planar surface being disposed parallel to said planes of said coil turns.

* * * * *